US007161288B2

(12) United States Patent
Takenaka et al.

(10) Patent No.: US 7,161,288 B2
(45) Date of Patent: Jan. 9, 2007

(54) IMAGE DISPLAY DEVICE WITH SUPPORT ASSEMBLY

(75) Inventors: Shigeo Takenaka, Fukaya (JP); Satoshi Ishikawa, Fukaya (JP); Masaru Nikaido, Ibo-gun (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/372,074

(22) Filed: Mar. 10, 2006

(65) Prior Publication Data

US 2006/0279199 A1 Dec. 14, 2006

Related U.S. Application Data

(63) Continuation of application No. PCT/JP2004/012952, filed on Sep. 6, 2004.

(30) Foreign Application Priority Data

Sep. 11, 2003 (JP) ..... 2003-319887

(51) Int. Cl.
*H01J 1/62* (2006.01)
*H01J 63/04* (2006.01)

(52) U.S. Cl. ..... 313/496; 313/495; 313/292

(58) Field of Classification Search ..... 313/495–497, 313/336, 309–310, 351, 346 R, 292, 238, 313/240, 243, 250, 258, 252–253
See application file for complete search history.

(56) References Cited

U.S. PATENT DOCUMENTS 6,107,731 A * 8/2000 Spindt et al. ..... 313/495
6,541,905 B1 * 4/2003 Fushimi et al. ..... 313/495
6,566,794 B1 * 5/2003 Miyazaki ..... 313/292
6,583,549 B1 * 6/2003 Takenaka et al. ..... 313/422
7,042,144 B1 * 5/2006 Takahashi et al. ..... 313/292

FOREIGN PATENT DOCUMENTS

| | | |
|---|---|---|
| JP | 2-61946 | 3/1990 |
| JP | 8-293270 | 11/1996 |
| JP | 2000-311642 | 11/2000 |
| JP | 2001-126633 | 5/2001 |

* cited by examiner

*Primary Examiner*—Nimeshkumar D. Patel
*Assistant Examiner*—Kevin Quarterman
(74) *Attorney, Agent, or Firm*—Oblon, Spivak, McClelland, Maier & Neustadt, P.C.

(57) ABSTRACT

A first substrate formed having a phosphor screen and a metal back layer and a second substrate provided with a plurality of electron emitting elements are located opposite each other. A spacer supporting substrate, which is covered by an insulating layer formed with a plurality of electron beam apertures, is provided between the first and second substrates. One first surface of the spacer supporting substrate is in contact with the first substrate with a plurality of conductive layers between them. A plurality of spacers are set up between the other surface of the spacer supporting substrate and the second substrate.

14 Claims, 6 Drawing Sheets

IMAGE DISPLAY DEVICE WITH SUPPORT ASSEMBLY

CROSS-REFERENCE TO RELATED APPLICATIONS

This is a Continuation Application of PCT Application No. PCT/JP2004/012952, filed Sep. 6, 2004, which was published under PCT Article 21(2) in Japanese.

This application is based upon and claims the benefit of priority from prior Japanese Patent Application No. 2003-319887, filed Sep. 11, 2003, the entire contents of which are incorporated herein by reference.

BACKGROUND OF THE INVENTION

1. Field of the Invention

This invention relates to a flat image display device provided with a pair of substrates opposed to each other.

2. Description of the Related Art

Various flat image display devices have been developed as a next generation of image display devices in which a large number of electron emitting elements are arranged side by side and opposed to a phosphor screen. While there are various types of electron emitting elements for use as electron emission sources, all of them basically utilize field emission. Display devices that use these electron emitting elements are generally called field emission displays (FED's). Among the FED's, a display device that uses surface-conduction electron emitting elements is also called a surface-conduction electron emission display (SED). In this specification, however, the term "FED" is used as a generic name for devices including the SED.

In general, an FED comprises a first substrate and a second substrate that are opposed to each other with a given gap between them. These substrates have their respective peripheral portions joined together by a sidewall in the shape of a rectangular frame, thereby constituting a vacuum envelope. The interior of the vacuum envelope is kept at a high vacuum such that the degree of vacuum is about $10^{-4}$ Pa or below. In order to support an atmospheric load that acts on the first substrate and the second substrate, a plurality of support members are located between these substrates.

A phosphor screen that includes red, blue, and green phosphor layers is formed on the inner surface of the first substrate, and a large number of electron emitting elements that emit electrons for exciting the phosphor to luminescence are provided on the inner surface of the second substrate. Further, a large number of scan lines and signal lines are formed in a matrix and connected to the electron emitting elements. An anode voltage is applied to the phosphor screen, and electron beams emitted from the electron emitting elements are accelerated by the anode voltage and collide with the phosphor screen, whereupon the phosphor glows and displays an image.

In the FED of this type, the gap between the first and second substrates can be set to several millimeters or less. When compared with a cathode-ray tube (CRT) that is used as a display of an existing TV or computer, therefore, the FED can achieve lighter weight and smaller thickness.

In order to obtain practical display characteristics for the FED constructed in this manner, it is necessary to use a phosphor that resembles that of a conventional cathode-ray tube and to use a phosphor screen that is obtained by forming a thin aluminum film called a metal back on the phosphor. In this case, the anode voltage to be applied to the phosphor screen should be set to at least several kV, and preferably, to 10 kV or more.

In view of the resolution, the properties of the support members, etc., the gap between the first substrate and the second substrate cannot be made very wide and should be set to about 1 to 2 mm. In the FED, therefore, a strong electric field is inevitably formed in the narrow gap between the first substrate and the second substrate, so that electric discharge (dielectric breakdown) between the substrates raises a problem.

If electric discharge occurs, a current of 100 A or more sometimes may flow instantaneously, so that the electron emitting elements and the phosphor screen may be broken or degraded, and moreover, a driver circuit may possibly be broken. These failures will be referred to collectively as electric discharge damage. Electric discharge that results in these failures is not allowed for products. In order to put the FED into practical use, it must be constructed so that it can be prevented from being damaged by electric discharge for a long period of time. It is very hard, however, to restrain electric discharge perfectly for a long period of time.

Supposedly, a measure may be taken to suppress the scale of electric discharge so that the influence of occurrence of electric discharge, if any, on the electron emitting elements, phosphor screen, and driver circuit is negligible, not to prevent generation of the electric discharge. A technique associated with this idea is disclosed in Jpn. Pat. Appln. KOKAI Publication No. 2000-311642, for example. According to this technique, a zigzag pattern or the like is formed by notching a metal back on a phosphor screen, whereby the effective inductance and resistance of the phosphor screen is enhanced. Disclosed in Jpn. Pat. Appln. KOKAI Publication No. 10-326583, on the other hand, is a technique in which a metal back is divided and connected to a common electrode through a resistance member so that a high voltage can be applied.

It is difficult, however, for even these techniques to fully restrain electric discharge damage to the phosphor screen and the electron emitting elements. There is another technique in which electric discharge is restrained by providing a high-resistance version of metal back. If the resistance of the metal back is enhanced, however, the metal back becomes transparent and inevitably ceases to fulfill its function.

BRIEF SUMMARY OF THE INVENTION

The present invention is contrived in consideration of the above circumstances, and its object is to provide a flat image display device with improved reliability, in which the scale of electric discharge generated between substrates can be suppressed, so that breakage and degradation of electron emitting elements and a phosphor screen and breakage of a circuit can be prevented.

In order to achieve the above object, an image display device according to an aspect of this invention comprises a first substrate having a phosphor screen including a phosphor layer and a metal back layer provided on the phosphor screen, a second substrate opposed to the first substrate with a gap therebetween and having thereon a plurality of electron emission sources which emit electrons toward the phosphor screen, a supporting substrate which has a plurality of electron beam apertures opposed to the electron emission sources, is covered by an insulating substance, and is located between the first and second substrates, and a plurality of spacers which are set up between the supporting substrate and the second substrate and support an atmospheric pressure acting on the first and second substrates, the supporting substrate being in contact with the first substrate with a plurality of conductive layers of an electrically conductive substance therebetween, the conductive layers being arranged spaced in a surface direction of the first substrate.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment in which this invention is applied to an SED as a flat image display device will now be described in detail with reference to the drawings.

Figure 1:
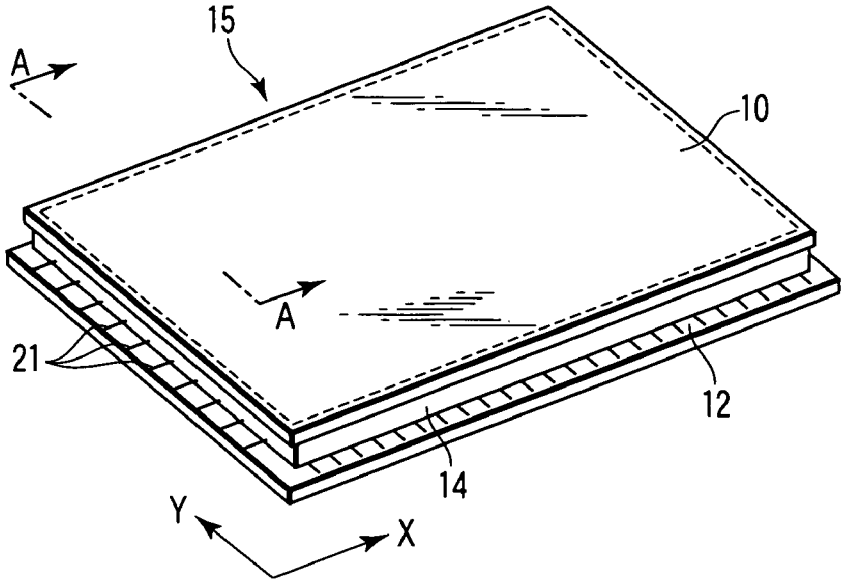
FIG. 1 is a perspective view showing an SED according to a first embodiment of this invention.
Figure 2:
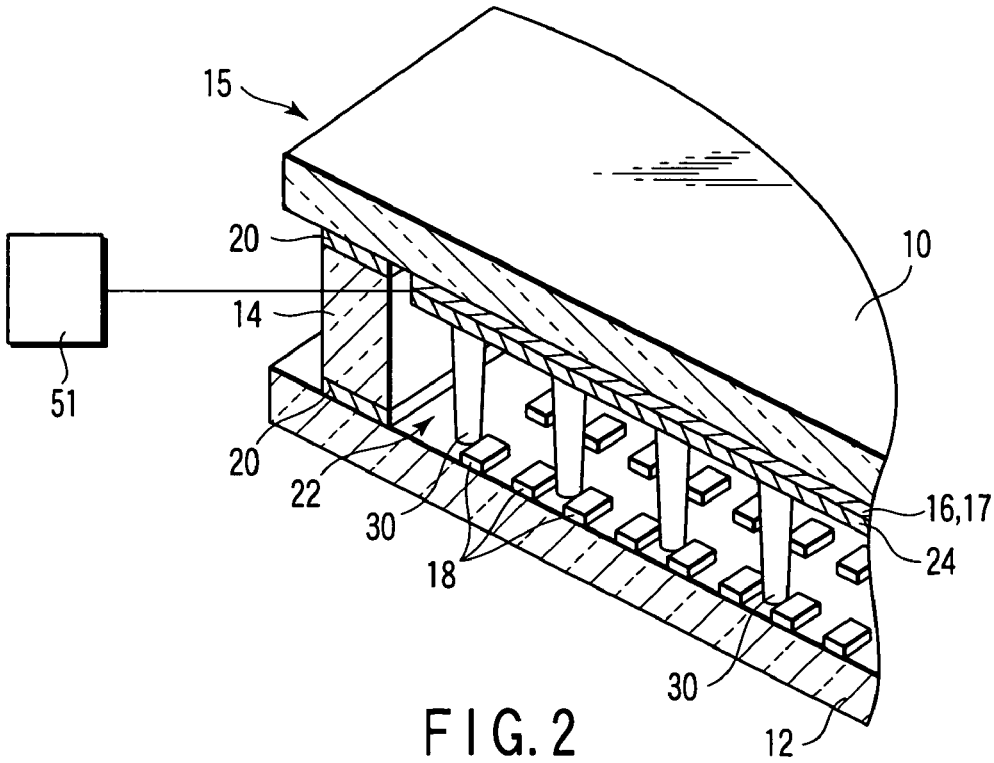
FIG. 2 is a perspective view of the SED cut away along line II—II of FIG. 1.
Figure 3:
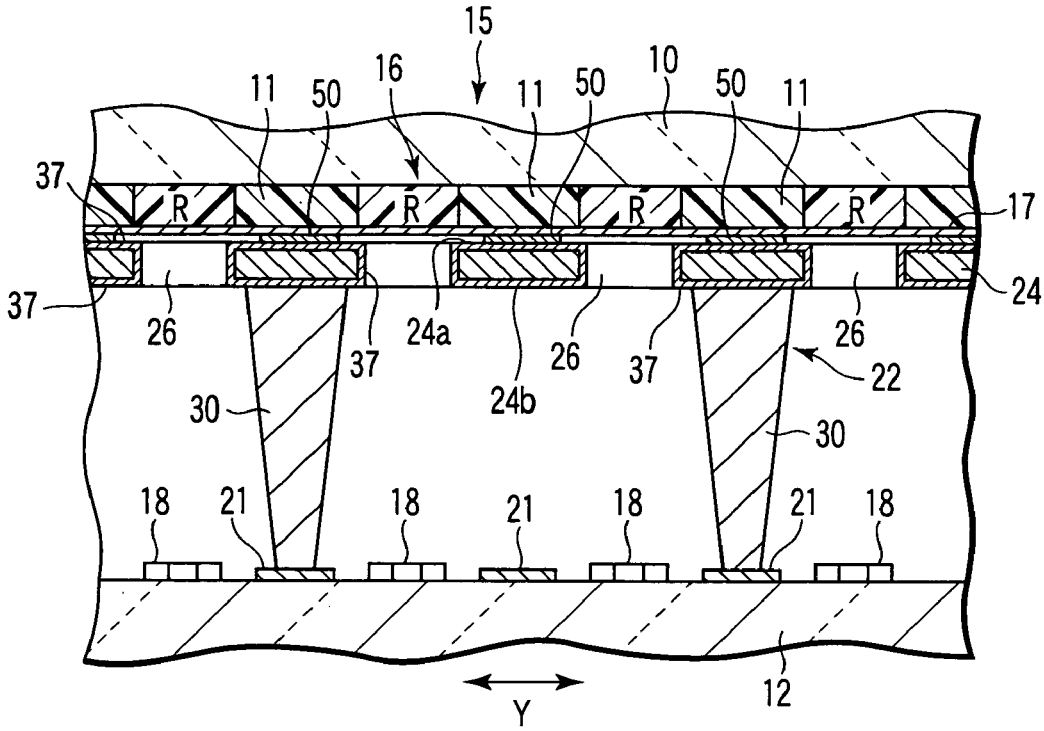
FIG. 3 is an enlarged sectional view of the SED.

As shown in FIGS. 1 to 3, the SED comprises a first substrate 10 and a second substrate 12, which are formed of a rectangular glass plate each. These substrates are located opposite each other with a gap of about 1.0 to 2.0 mm between them. The first substrate 10 and the second substrate 12 have their respective peripheral edge portions joined together by a sidewall 14 of glass in the form of a rectangular frame, thereby forming a flat, rectangular vacuum envelope 15 of which the interior is kept at a high vacuum of about $10^{-4}$ Pa or less.

A phosphor screen 16 that serves as a phosphor surface is formed on the inner surface of the first substrate 10. As mentioned later, the phosphor screen 16 has phosphor layers R, G and B, which glow red, green, and blue, respectively, and a matrix-shaped light shielding layer. Formed on the phosphor screen 16 is a metal back layer 17 that consists mainly of, for example, aluminum.

Provided on the inner surface of the second substrate 12 are a large number of surface-conduction electron emitting elements 18 as electron sources, which individually emit electron beams that excite the phosphor layers R, G and B of the phosphor screen 16. These electron emitting elements 18 are arranged in a plurality of columns and a plurality of rows corresponding to individual pixels. Each electron emitting element 18 is formed of an electron emitting portion (not shown), a pair of element electrodes that apply voltage to the electron emitting portion, etc. A large number of wires 21 that supply potential to the electron emitting elements 18 are arranged in a matrix manner on the inner surface of the second substrate 12, and their respective end portions are drawn out of the vacuum envelope 15. The sidewall 14 that serves as a joint member is sealed to the peripheral edge portion of the first substrate 10 and the peripheral edge portion of the second substrate 12 by sealing materials 20, such as low-melting glass or low-melting metal, thereby joining the substrates together.

Figure 4:
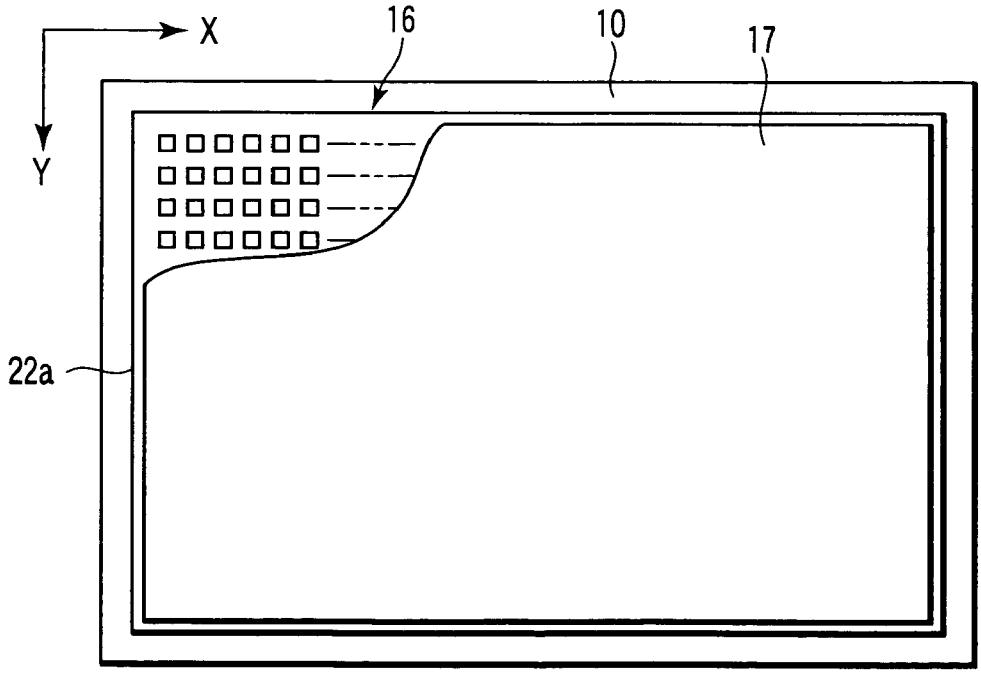
FIG. 4 is a plan view showing the inner surface of a first substrate of the SED.
Figure 5:
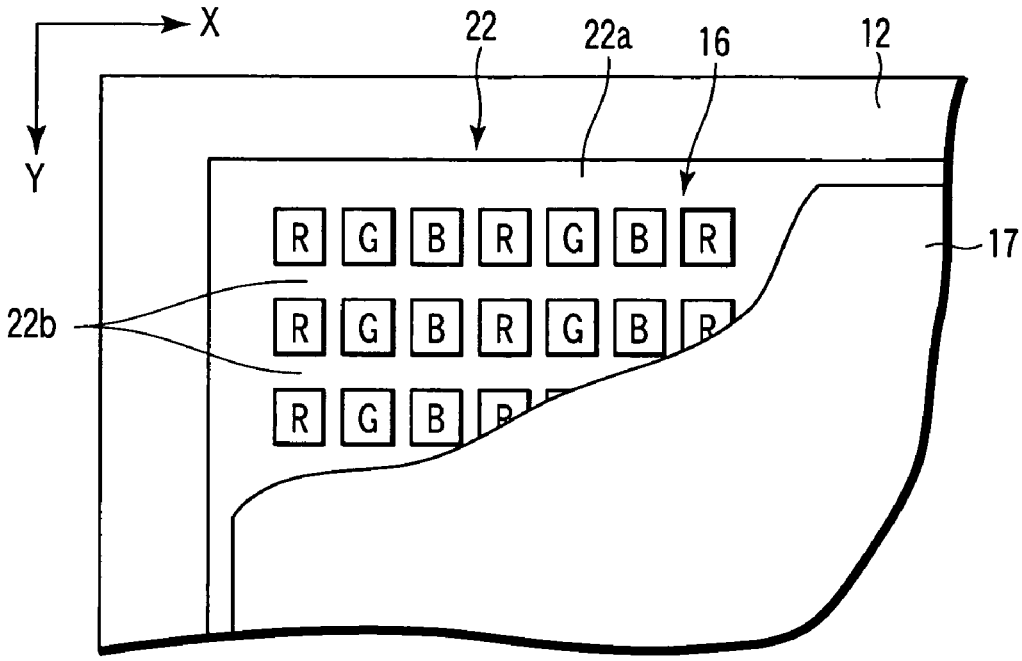
FIG. 5 is an enlarged plan view showing a phosphor screen of the SED.

In the phosphor screen 16 provided on the inner surface of the first substrate 10, as shown in FIGS. 4 and 5, each of the phosphor layers R, G and B has a rectangular shape. If the longitudinal direction and the transverse direction perpendicular thereto are a first direction X and a second direction Y, respectively, the phosphor layers R, G and B are alternately arranged with given gaps in the first direction X between them, and phosphor layers of the same colors are arranged with given gaps in the second direction between them. The phosphor screen 16 has a black light shielding layer 11, and this light shielding layer has a rectangular frame portion 22*a*, which extends along the peripheral edge portion of the first substrate 10, and a matrix portion 22*b*, which extends in a matrix between the phosphor layers R, G and B inside the rectangular frame portion.

The metal back layer 17 has a rectangular shape and is formed substantially overlapping the entire surface of the phosphor screen 16. Although the term "metal back layer" is used in the present invention, this layer is not limited to metal, and various materials may be used for it. In this specification, however, the term "metal back layer" is used for the sake of convenience.

As shown in FIGS. 2 and 3, the SED comprises a spacer structure 22 that is interposed between the first substrate 10 and the second substrate 12. The spacer structure 22 is provided with a spacer supporting substrate 24 formed of a rectangular metal plate and a large number of columnar spacers 30 set up integrally on the spacer supporting substrate. The spacer supporting substrate 24, which serves as a supporting substrate according to this invention, has a first surface 24*a* opposed to the inner surface of the first substrate 10 and a second surface 24*b* opposed to the inner surface of the second substrate 12 and is located parallel to these substrates. A large number of electron beam apertures 26 are formed in the spacer supporting substrate 24 by etching or the like. The electron beam apertures 26 are arranged opposite the electron emitting elements 18, individually, and electron beams emitted from the electron emitting elements are transmitted through them.

Figure 6:
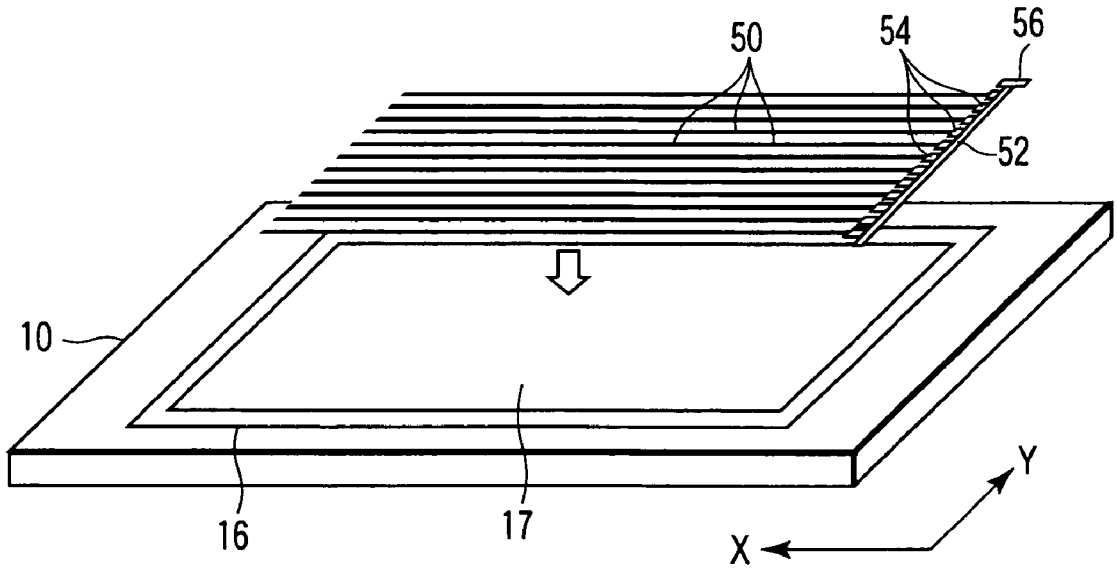
FIG. 6 is an exploded perspective view showing the first substrate and conductive layers of the SED.

The first and second surfaces 24*a* and 24*b* of the spacer supporting substrate 24 and the inner wall surface of each electron beam aperture 26 are covered by an insulating layer 37 with a thickness of about 40 μm, formed of an insulating material consisting mainly of glass or the like, such as Li-based borosilicate alkali glass. As shown in FIGS. 3 and 6, a plurality of conductive layers 50 of an electrically conductive substance are formed on the first surface 24*a* of the spacer supporting substrate 24. These conductive layers 50 are arranged spaced in the surface direction of the spacer supporting substrate 24, that is, in the surface direction of the second substrate 12. In the present embodiment, the conductive layers 50 extend like stripes in the first direction X and are arranged at given intervals in the second direction Y. The conductive layers 50 are formed in positions off the electron beam apertures 26. A material that contains at least one of substances including gold, silver, copper, iron, nickel, cobalt, manganese, chromium, aluminum, and their oxides is used as the electrically conductive substance that forms the conductive layers 50.

A stripe-shaped common electrode 52 is formed overlapping the insulating layer 37 on the first surface of the spacer supporting substrate 24. The common electrode 52 is formed by screen-printing a silver paste, for example. The common electrode 52 extends along the second direction Y and is located adjacent to respective one ends of the conductive layers 50. The one end of each conductive layer 50 is connected to the common electrode 52 by means of a connecting resistor 54. The connecting resistor 54 has a resistance value higher than that of the conductive layer 50. Further, a feeder terminal 56 for connection with a high-voltage power source is provided on one end portion of the common electrode 52.

The spacer supporting substrate 24 is located so that its first surface 24*a* is in contact with the metal back layer 17 of the second substrate 12 with the conductive layers 50 between them. The electron beam apertures 26 in the spacer supporting substrate 24 are opposed to the phosphor layers R, G and B of the phosphor screen 16 and the electron emitting elements 18 on the second substrate 12. Thus, each electron emitting element 18 faces its corresponding phosphor layer through the electron beam apertures 26. The conductive layers 50 formed on the first surface 24*a* of the spacer supporting substrate 24 are in contact with the metal back layer 17 in positions opposite to the light shielding layer 11 of the phosphor screen 16.

A large number of spacers 30 are set up integrally on the second surface 24*b* of the spacer supporting substrate 24. An extending end of each spacer 30 abuts against the inner surface of the second substrate 12, or in this case, against each corresponding wire 21 on the inner surface of the second substrate 12. Each of the spacers 30 is tapered so that its diameter is reduced from the side of the spacer supporting substrate 24 toward its extending end. For example, the spacer 30 is formed having a height of about 1.8 mm. The cross section of the spacer 30 parallel to the spacer supporting substrate surface is substantially elliptic. Primarily, each of the spacers 30 is formed of a spacer forming material that consists mainly of glass as an insulating substance.

As the extending ends of the spacers 30 abut against the inner surface of the second substrate 12 with the spacer supporting substrate 24 in contact with the first substrate 10, the spacer structure 22 constructed in this manner supports an atmospheric pressure load that acts on these substrates, thereby keeping the space between the substrates at a given value.

The SED is provided with a power source 51 that applies an anode voltage of about 10 kV to the conductive layers 50 formed on the spacer supporting substrate 24. The power source 51 is connected to the feeder terminal 56 of the common electrode 52 through a contact pin (not shown). In displaying an image on the SED, an anode voltage from the power source 51 is applied to the metal back layer 17 and the phosphor screen 16 through the common electrode 52, connecting resistors 54, and conductive layers 50, and electron beams emitted from the electron emitting element 18 are accelerated by the anode voltage and collided against the phosphor screen 16. Thereupon, the phosphor layers of the phosphor screen 16 are excited to luminescence and display the image.

The following is a description of a manufacturing method for the SED constructed in this manner. A manufacturing method for the spacer structure 22 will be described first.

Figure 7:
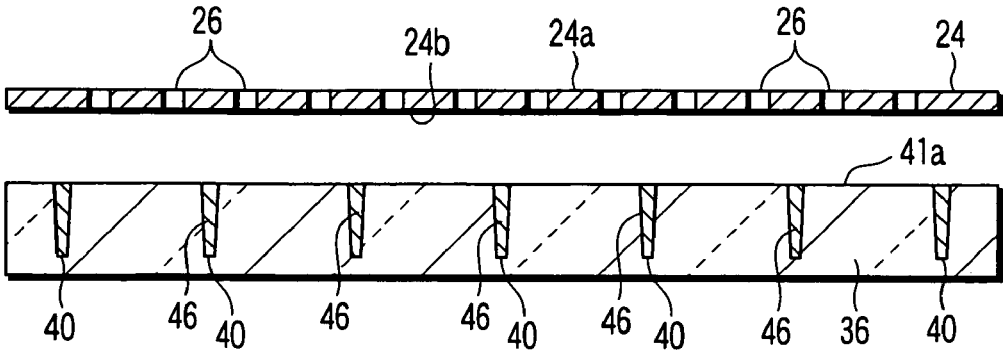
FIG. 7 is a sectional view showing a manufacturing process for a spacer structure of the SED.

In manufacturing the spacer structure 22, as shown in FIG. 7, the spacer supporting substrate 24 of given dimensions and a molding die 36 in the form of a rectangular plate having substantially the same dimensions as the spacer supporting substrate are prepared. In this case, the spacer supporting substrate 24 is obtained by degreasing, cleaning, and drying a metal plate of Fe-50% Ni with a thickness of 0.12 μm and then forming a large number of electron beam apertures 26 in it by etching. Each electron beam aperture 26 measures 180 μm by 180 μm. A material that contains at least one of substances including iron, nickel, cobalt, manganese, aluminum, and their oxides may be used as the material of the spacer supporting substrate 24.

Thereafter, the insulating layer 37 is formed by spreading a glass frit to a thickness of 40 μm on the entire surface of the spacer supporting substrate 24 including the respective inner surfaces of the electron beam apertures 26, drying it, and then calcining it.

The molding die 36 is a flat plate formed of a transparent material that transmits ultraviolet rays, e.g., transparent silicone consisting mainly of transparent polyethylene terephthalate. The molding die 36 has a flat engaging surface 41*a* that engages the spacer supporting substrate 24 and a large number of bottomed spacer forming holes 40 for molding the spacers 30. The spacer forming holes 40 individually open in the engaging surface 41 of the molding die 36 and are arranged at given intervals. Each spacer forming hole 40 is formed having a length of 1,000 μm, width of 350 μm, and height of 1,800 μm, corresponding to each spacer 30. Thereafter, a spacer forming material 46 is filled into the spacer forming holes 40 of the molding die 36. A glass paste that contains at least an ultraviolet-curing binder (organic component) and a glass filler is used for the spacer forming material 46. The specific gravity and viscosity of the glass paste are selected as required.

Figure 8:
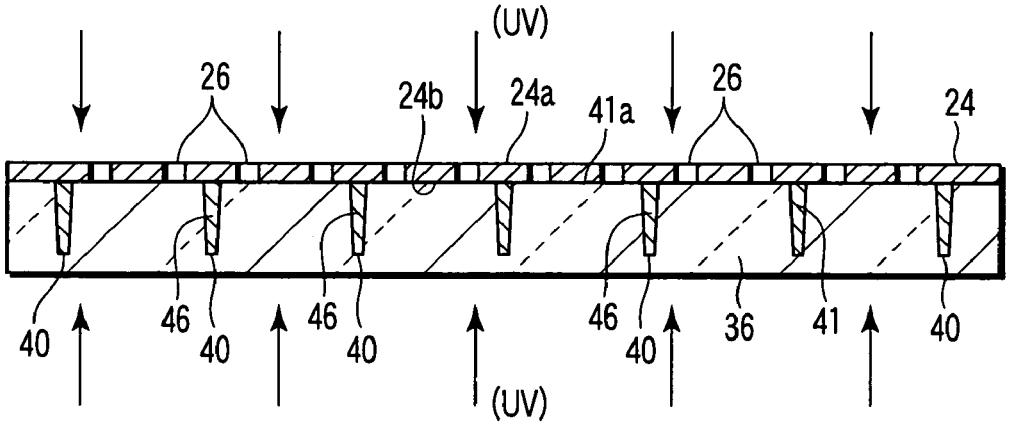
FIG. 8 is a sectional view showing an assembly formed of a molding die and a spacer supporting substrate intimately in contact with each other.

Subsequently, as shown in FIG. 8, the molding die 36 is positioned so that the spacer forming holes 40 filled with the spacer forming material 46 are situated between the electron beam apertures 26 and the engaging surface 41 is brought intimately into contact with the first surface 24*a* of the spacer supporting substrate 24. Thus, an assembly is formed comprising the spacer supporting substrate 24 and the molding die 36.

Then, as shown in FIG. 8, ultraviolet (UV) rays of 2,000 mJ are applied to the filled spacer forming material 46 from outside the spacer supporting substrate 24 and the molding die 36 by using, for example, an ultraviolet lamp or the like, whereby the spacer forming material is UV-cured. In this case, the molding die 36 that is loaded with the spacer forming material 46 is formed of the transparent silicon as an ultraviolet-transmitting material. Therefore, ultraviolet rays are applied to the spacer forming material 46 directly and through the molding die 36. Thus, the filled spacer forming material 46 can be securely cured to its inner part.

Figure 9:
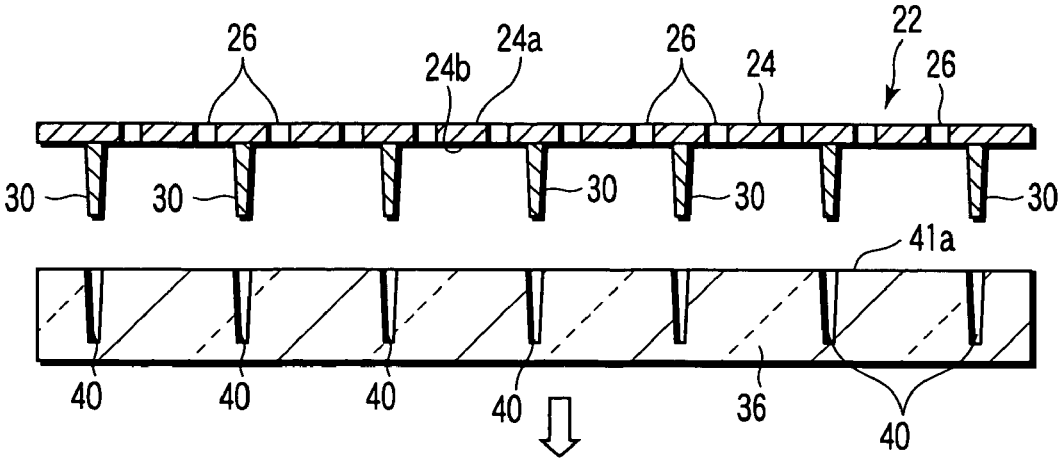
FIG. 9 is a sectional view showing the molding die in a released state.

As shown in FIG. 9, thereafter, the molding die 36 is separated from the spacer supporting substrate 24 so that the cured spacer forming material 46 is left on the spacer supporting substrate 24. Then, the spacer supporting substrate 24 having the spacer forming material 46 thereon is heat-treated in a heating oven, whereby the binder is removed from the spacer forming material. Thereafter, the spacer forming material is regularly calcined to be vitrified at about 500 to 550° C. for 30 minutes to one hour.

Figure 10:
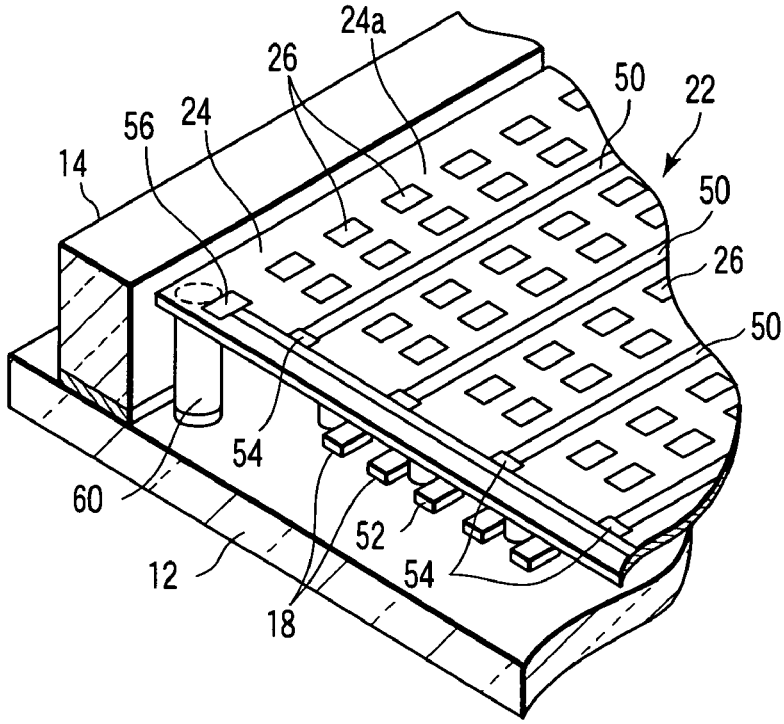
FIG. 10 is a perspective view showing a state in which the spacer structure is fixed on a second substrate.

Then, as shown in FIGS. 6 and 10, strips of a silver paste are spread on the first surface 24*a* of the spacer supporting substrate 24 by, for example, screen printing at pitches of 0.615 mm in the second direction Y. Each strip extends in the first direction X and is 50 μm wide and 10 μm thick. These silver paste strips are calcined in an atmosphere of 400° C. for 30 minutes, whereupon the conductive layers 50 are formed directly on the first surface 24*a* of the spacer supporting substrate 24. At the same time, the common electrode 52 that extends in the second direction Y on the first surface 24*a* and the feeder terminal 56 are formed by silver paste printing. Further, the connecting resistors 54 that connect the conductive layers 50 and the common electrode 52 are formed on the first surface 24*a*. Thus, the spacer structure 22 is obtained.

In manufacturing the SED, the first substrate 10 having the phosphor screen 16 and the metal back layer 17 thereon and the second substrate 12 having the electron emitting elements 18 and the wires 21 thereon and joined with the sidewall 14 are prepared in advance. After the spacer structure 22 obtained in this manner is then positioned on the second substrate 12, the four corners of the spacer supporting substrate 24 are welded individually to metallic posts 60 that are set up individually on four corner portions of the second substrate. It is necessary only that the spacer supporting substrate 24 be fixed at least in two positions.

Thereafter, the first substrate 10 and the second substrate 12 having the spacer structure 22 fixed thereto are located in a vacuum chamber, the vacuum chamber is evacuated, and the first substrate is then joined to the second substrate by means of the sidewall 14. Thus, the SED provided with the spacer structure 22 is manufactured.

According to the SED constructed in this manner, the spacers 30 are provided only on that side of the spacer supporting substrate 24 which faces the second substrate 12. Therefore, each spacer can be lengthened so that the distance between the spacer supporting substrate 24 and the second substrate 12 is long. Thus, the voltage resistance between the spacer supporting substrate and the second substrate is improved, so that generation of electric discharge between these substrates can be restrained.

A plurality of conductive layers 50 that are spaced in the surface direction are formed on the first surface 24*a* of the spacer supporting substrate 24, and the spacer supporting substrate is provided in contact with the inner surface of the first substrate 10 or the metal back layer 17 with the conductive layers 50 between them. Accordingly, the potential of those parts of the metal back layer 17 which are in contact with the conductive layers 50 can be partially regulated by the potential of the conductive layers 50. Even if an electric discharge is generated between the first and second substrates 10 and 12, therefore, no voltage drop is caused in a region where the metal back layer and the conductive layers 50 are in contact with one another. In consequence, the scale of the electric discharge can be reduced to restrain a large electric discharge. Thus, breakage and degradation of the electron emitting elements and the phosphor screen and breakage of the circuit can be prevented, so that an SED of improved reliability can be obtained.

Further, the metal back layer 17 and the phosphor screen 16 are pressed by the spacer supporting substrate 24 through the conductive layers 50. Therefore, peeling of the metal back layer 17 and damage to the metal back layer and the phosphor screen 16 can be prevented. Thus, a satisfactory image quality level can be maintained for a long period of time. At the same time, generation of electric discharge attributable to the separated metal back can be restrained, so that an SED of improved reliability can be obtained.

Figure 11:
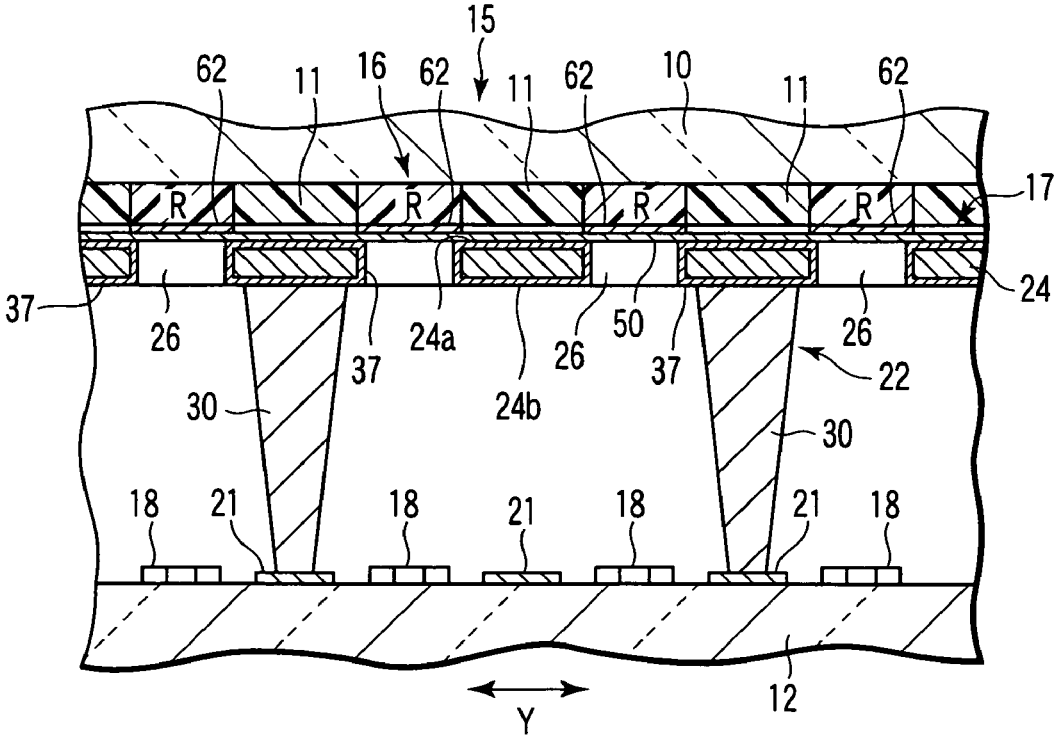
FIG. 11 is a sectional view showing an SED according to a second embodiment of this invention.
Figure 12:
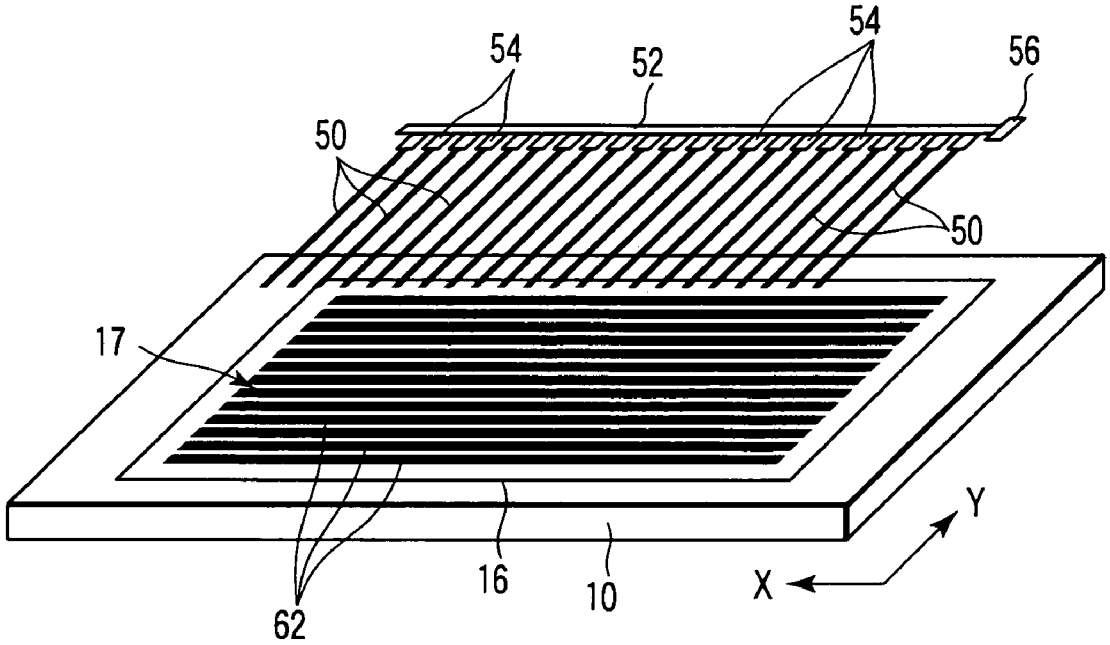
FIG. 12 is an exploded perspective view showing a first substrate and conductive layers of the SED according to the second embodiment.

The following is a description of an SED according to a second embodiment of this invention. According to the second embodiment, as shown in FIGS. 11 and 12, a metal back layer 17 provided on a phosphor screen 16 of a first substrate 10 is divided into a plurality of parts. In this case, the metal back layer 17 is formed of a plurality of stripe-shaped divided layers 62 that individually extend in the first direction X and are arranged spaced in the second direction Y. These divided layers 62 are provided individually overlapping phosphor layers R, G and B of the phosphor screen 16.

Conductive layers 50 that are formed on a first surface 24*a* of a spacer supporting substrate 24 individually extend like stripes in the second direction Y and are spaced in the first direction X from one another. Thus, each conductive layer 50 extends across the divided layers 62, or in this case, at right angles to them. A stripe-shaped common electrode 52 is formed on the first surface 24*a* so as to overlap an insulating layer 37. The common electrode 52 extends in the first direction X and is located adjacent to respective one ends of the conductive layers 50. The one end of each conductive layer 50 is connected to the common electrode 52 by means of a connecting resistor 54. The connecting resistor 54 has a resistance value higher than that of the conductive layer 50. Further, a feeder terminal 56 for connection with a high-voltage power source is provided on one end portion of the common electrode 52. The spacer supporting substrate 24 constructed in this manner is in contact with the metal back layer 17 with the metal back layer 17 with the conductive layers 50 between them.

The other configurations of an SED are the same as those of the first embodiment, so that like portions are designated by like reference numerals, and a detailed description thereof is omitted.

In manufacturing the spacer structure 22 by the manufacturing method for the SED constructed in this manner, strips of a silver paste are spread on the first surface 24*a* of the spacer supporting substrate 24 by screen printing at pitches of 0.615 mm in the first direction X. Each strip extends in the second direction Y and is 20 μm wide and 5 μm thick. These silver paste strips are calcined in an atmosphere of 400° C. for 30 minutes, whereupon the conductive layers 50 are formed directly on the first surface 24*a* of the spacer supporting substrate 24. Further, the metal back layer 17 of the first substrate 10 is formed of the plurality of divided layers 62 that are arranged with a width of 200 μm and at pitches of 0.615 mm in the second direction Y. The other processes of the manufacturing method are the same as the ones according to the first embodiment, so that a detailed description thereof is omitted.

In the second embodiment arranged in this manner, as in the first embodiment, the voltage resistance between the spacer supporting substrate and the second substrate is improved, so that generation of electric discharge between these substrates can be restrained. Even if electric discharge is generated between the first and second substrates, moreover, no voltage drop is caused in a region where the metal back layer and the conductive layers 50 are in contact with one another. In consequence, the scale of the electric discharge can be reduced to restrain large electric discharge. Thus, breakage and degradation of electron emitting elements and the phosphor screen and breakage of the circuit can be prevented, so that an SED of improved reliability can be obtained. According to the second embodiment, furthermore, the metal back layer 17 is divided into the plurality of divided layers 62, so that the region of contact with the conductive layers 50 can be divided into a larger number of parts. Even if electric discharge is generated, therefore, regions where voltage drops occur can be further lessened, so that the scale of the electric discharge can be further reduced. Further, the same functions and effects as those of the foregoing first embodiment can be obtained.

If electric discharge is generated, it is hard to accurately measure actual discharge current. Therefore, the inventors hereof recognized that the electric discharge restraining effect was related to damage to the first and second substrates and the driver for drive. When an electric discharge was generated corresponding to a voltage of 10 kV, electric discharge craters with a diameter of 2 to 3 mm were formed on the first substrate of a conventional SED, and the driver for drive was partially damaged. In the case of the SED in which the conductive layers are formed on the spacer supporting substrate, as in the first embodiment described above, on the other hand, the driver for drive was never damaged, although electric discharge craters with a diameter of 0.5 mm or less were produced. In the case of the SED in which the metal back layer is divided into the plurality of divided layers, as in the second embodiment, moreover, no electric discharge craters were found, and the driver for drive was not damaged either.

The present invention is not limited directly to the embodiments described above, and its components may be embodied in modified forms without departing from the spirit of the invention. Further, various inventions may be made by suitably combining a plurality of components described in connection with the foregoing embodiments. For example, some of all the components according to the foregoing embodiments may be omitted. Furthermore, components according to different embodiments may be combined as required.

For example, the conductive layers on the spacer supporting substrate must only be spaced from each other in the surface direction of the metal back layer and may be formed having any other shape than the shape of stripes. Although the conductive layers according to the foregoing embodiments are formed extending at right angles to the divided layers that constitute the metal back layer, moreover, they are expected only to extend across the divided layers. Furthermore, the conductive layers and the divided layers may be formed extending in the first direction X and the second direction Y, respectively.

In the embodiments described above, a large number of spacers are formed integrally on the spacer supporting substrate. Alternatively, however, they may be set up on the second substrate. The spacers are not limited to the independent spacers used in the foregoing embodiments but may be replaced with any other spacers, such as plate-like spacers. Also in this case, as in the foregoing embodiments, an electric discharge restraining effect and a reduction in the scale of the electric discharge can be realized, so that the reliability can be improved.

Further, the width and diameter of the spacers, the dimensions and materials of the other components, etc. are not limited to the foregoing embodiments but may be suitably selected as required. Filling conditions for the spacer forming material may be variously selected as required. Further, this invention is not limited to the case where the surface-conduction electron emitting elements are used as electron sources but may alternatively be applied to image display devices that use any other electron sources, such as the field-emission type, carbon nanotubes, etc.

What is claimed is:

1. An image display device comprising:

a first substrate having a phosphor screen including a phosphor layer and a metal back layer arranged on the phosphor screen;

a second substrate opposed to the first substrate with a gap therebetween and having thereon a plurality of electron emission sources which emit electrons toward the phosphor screen;

a supporting substrate which has a plurality of electron beam apertures opposed to the electron emission sources, is covered by an insulating substance, and is located between the first and second substrates; and a plurality of spacers which are set up between the supporting substrate and the second substrate and support an atmospheric pressure acting on the first and second substrates, the supporting substrate being in contact with the first substrate with a plurality of conductive layers of an electrically conductive substance therebetween, the conductive layers being arranged spaced in a surface direction of the first substrate.

2. The image display device according to claim 1, wherein the conductive layers are formed in a shape of a stripe each, arranged spaced from one another, and located off the electron beam apertures.

3. The image display device according to claim 1, wherein the metal back layer is formed of a plurality of stripe-shaped divided layers arranged spaced from one another.

4. The image display device according to claim 3, wherein the plurality of conductive layers are formed in a shape of a stripe each and extend across the divided layers.

5. The image display device according to claim 4, wherein the phosphor layers are formed of phosphor layers of a plurality of colors, the phosphor layers of the plurality of colors being alternately arranged in a first direction, the phosphor layers of the same color being arranged in a second direction perpendicular to the first direction, the plurality of divided layers which form the metal back layer extending in one of the first and second directions, and the plurality of conductive layers extending at right angles to the divided layers.

6. The image display device according to claim 1, wherein the phosphor screen includes a light shielding layer formed between the adjacent phosphor layers, the conductive layers overlapping the light shielding layer.

7. The image display device according to claim 1, wherein the conductive layers are formed on that surface of the supporting substrate which faces the first substrate.

8. The image display device according to claim 1, which further comprises a common electrode provided on the supporting substrate, each of the conductive layers being connected to the common electrode through a connecting resistor having a resistance value higher than that of the conductive layers.

9. The image display device according to claim 1, which comprises a power source which supplies an anode voltage to the conductive layers.

10. The image display device according to claim 1, wherein the supporting substrate is fixed to the second substrate.

11. The image display device according to claim 1, wherein the spacers are set up integrally on that surface of the supporting substrate which faces the second substrate.

12. The image display device according to claim 1, wherein the electrically conductive substance contains at least one of substances including gold, silver, copper, iron, nickel, cobalt, manganese, chromium, aluminum, and their oxides.

13. The image display device according to claim 1, wherein the supporting substrate contains at least one of substances including iron, nickel, cobalt, manganese, aluminum, and their oxides.

14. The image display device according to claim 1, wherein the insulating substance is glass.

* * * * *